US007580645B2

(12) United States Patent
Able et al.

(10) Patent No.: US 7,580,645 B2
(45) Date of Patent: Aug. 25, 2009

(54) DETECTING THE PRESENCE OF A PHOTOCONDUCTOR DRUM

(75) Inventors: Douglas Anthony Able, Shelbyville, KY (US); Kermit Arnold Meece, Lexington, KY (US); Jared Kuo-Hui Lin, Lexington, KY (US)

(73) Assignee: Lexmark International, Inc

( * ) Notice: Subject to any disclaimer, the term of this patent is extended or adjusted under 35 U.S.C. 154(b) by 223 days.

(21) Appl. No.: 11/352,564

(22) Filed: Feb. 13, 2006

(65) Prior Publication Data

US 2007/0189782 A1 Aug. 16, 2007

(51) Int. Cl.
*G03G 15/00* (2006.01)

(52) U.S. Cl. ..... 399/13

(58) Field of Classification Search ..... 399/13, 399/24, 25, 26, 107, 111, 116, 117
See application file for complete search history.

(56) References Cited

U.S. PATENT DOCUMENTS

| | | | | |
|---|---|---|---|---|
| 5,909,603 | A * | 6/1999 | Suzuki et al. | 399/13 |
| 6,029,019 | A * | 2/2000 | Kawai | 399/13 |
| 6,295,423 | B1 * | 9/2001 | Haines et al. | 399/24 |
| 6,311,026 | B1 * | 10/2001 | Higeta et al. | 399/13 |
| 6,934,485 | B2 * | 8/2005 | Miyabe et al. | 399/90 |
| 7,272,328 | B2 * | 9/2007 | Ream et al. | 399/13 |

FOREIGN PATENT DOCUMENTS

JP 9-90771 * 4/1997

* cited by examiner

*Primary Examiner*—Hoan H Tran

(57) ABSTRACT

The presence of a photoconductor drum in a laser printer may be determined by making electrical measurements without directly sensing drum presence. In some embodiments, this may be done without using any added printer components.

25 Claims, 3 Drawing Sheets

DETECTING THE PRESENCE OF A PHOTOCONDUCTOR DRUM

BACKGROUND

This invention relates generally to electrophotographic imaging.

In an electrophotographic imaging apparatus comprised of many components, it is desirable for the control system to have knowledge that all of the components required for imaging are present before starting an imaging operation. This is particularly true for a laser printer where some or all of these components are removable or replaceable by the user.

Laser printers have utilized an imaging system consisting of a photoconductor drum which is physically contacted by a charging mechanism (charge roll), a developing mechanism (developer roll), a transfer mechanism (transfer roll), and a scanning laser beam. In printing, the photoconductor drum is rotated within the printer. Electrical charge is applied to the surface of the photoconductor drum by the charge roll. With further rotation, the charged surface of the photoconductor drum is selectively discharged by the laser beam, depending on whether the laser is on or off as it scans over any particular point on the drum surface. With further rotation, the selectively discharged surface of the photoconductor drum reaches the developer roll, where toner is developed to the drum depending on the voltage difference. With further rotation the developed image reaches the transfer roll, where a voltage applied to the transfer roll can attract toner away from the photoconductor drum, ultimately transferring the image to the print media which passes between the photoconductor drum and the transfer roll.

The printer contains a high-voltage power supply which includes separate outputs connected to the core of the photoconductor drum, the charge roll, the developer roll, and the transfer roll. The voltage applied to the core of the photoconductor drum is controllable only as to off or on to a fixed voltage. The voltages applied to the charge roll, the developer roll, and the transfer roll are each separately controllable by the printer firmware to various voltages. There is also a feedback signal that provides a basic indication of the amount of electrical current flowing into the transfer roll, specifically whether the current is above or below a fixed pre-determined threshold. The primary reason for this signal is that the electrical resistivity of the transfer roll varies with environmental conditions, and by determining the voltage at which this current threshold is reached, the printer can get an indication of the environment and tailor operating parameters for best results.

In many laser printers, the photoconductor drum has been included in a toner cartridge supply item that also includes the developing mechanism and the toner. The printer's control system detects the presence of the toner cartridge by successfully communicating with a memory device located on the toner cartridge.

Other printers may employee a design where the photoconductor drum is not included in the toner cartridge supply item, but rather as a separate supply item known as a photoconductor unit (which may also include the charging mechanism). In many of these printers, the user cannot install a toner cartridge without first installing a photoconductor unit, so the method for detecting the toner cartridge is effective in determining that the photoconductor unit is installed in the printer.

A printer may include a separate toner cartridge and photoconductor unit, so the toner cartridge can be installed without the photoconductor unit in place. Therefore, the method of detecting the toner cartridge cannot be used to determine if the photoconductor unit is installed in the printer. Additionally, the photoconductor drum may comprise an integral part of the paper path in the printer design; attempted printing without a photoconductor unit installed will result in paper stoppage and require user intervention inside the printer to clear the paper jam. It is therefore highly desirable for the control system of the printer to have knowledge that the photoconductor unit is installed before attempting any printing operation.

DETAILED DESCRIPTION

Figure 1:
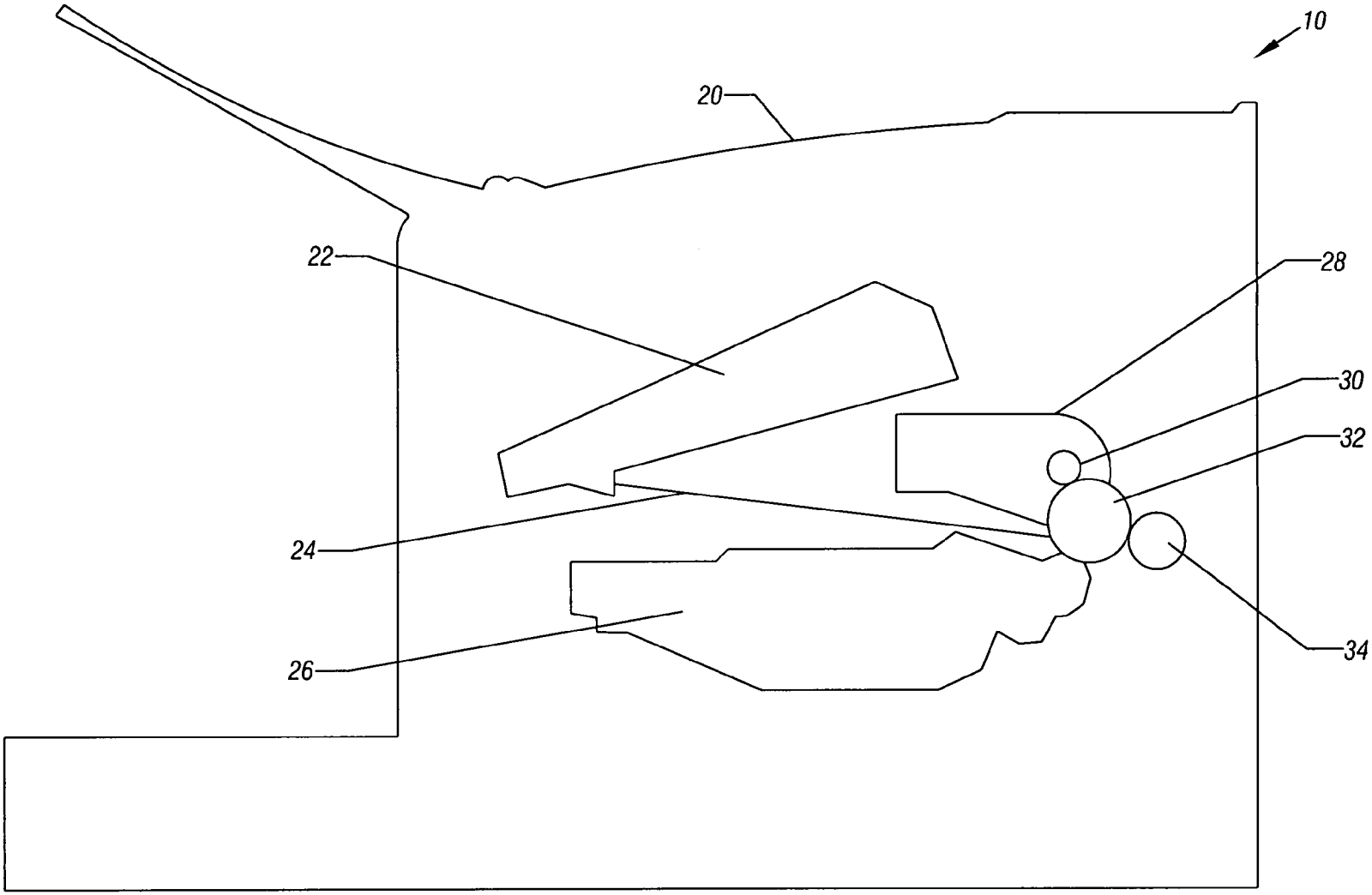
FIG. 1 is a generalized depiction of a laser printer in accordance with one embodiment of the present invention.

Referring to FIG. 1, a method for determining the presence of a photoconductor drum 32 can be employed in a laser printer 10, in some embodiments, without any additional hardware specific to the detection, thus with no incremental monetary cost. The printer 10 may include a housing 20, a printhead 22 emitting a laser beam 24, a toner cartridge 26, a charge roll 30, a photoconductor unit 28 and a transfer roll 34.

The transfer roll 34 may physically contact the photoconductor drum 32 when the drum is installed. The photoconductor drum may be the only electrically conductive object in direct physical contact with the transfer roll 34. Because current sensing of the printer's high-voltage power supply transfer output is available, this signal can be effectively used to determine the presence of the photoconductor drum 32.

Photoconductor drum detection is preferably only performed when the conditions exist that a photoconductor unit may have been removed by a user. Those conditions may include powering on of the printer, or when the access door (not shown) to the part of the-printer where the photoconductor unit 28 is located has been opened. These scenarios can be extended to a more generalized case to provide efficiencies in the control firmware, but because the detection may take some time, the detection will preferably not take place during or between normal printing operations.

Figure 2:
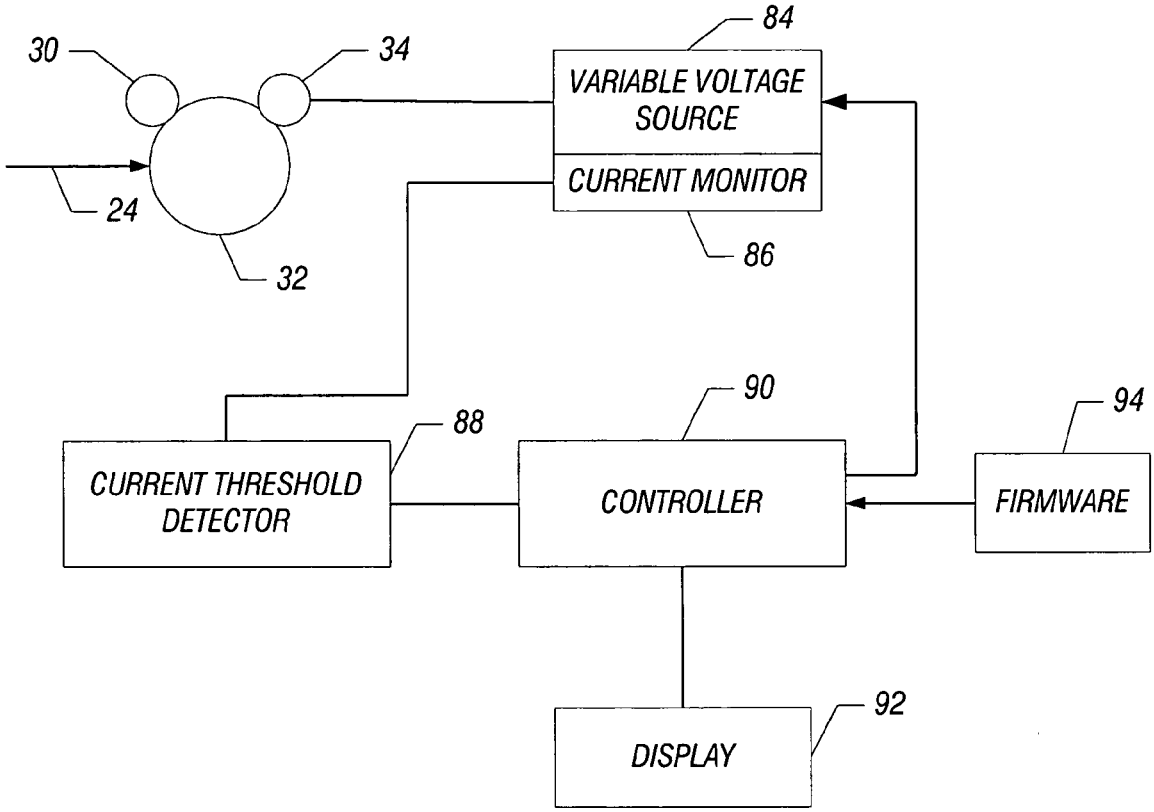
FIG. 2 is a schematic depiction of a control system for a laser printer in accordance with one embodiment of the present invention.

Referring to FIG. 2, a controller 90 in the printer 10 may run printer control firmware 94. The controller 90 may be coupled to a user display 92. In a first stage, the printer control firmware 94 may run the printer's drive motor (not shown) so that any installed photoconductor drum 32 rotates. A highly negative voltage (e.g., -1600 volts) is applied to the charge roll 30, which charges the surface of any installed photoconductor drum 32. After enough time has elapsed for the charged portion of the photoconductor drum 32 to be in contact with the transfer roll 34, the printer control firmware 94 begins to vary the voltage applied to the transfer roll 34 by the voltage source 84 and monitor the transfer current feedback in current monitor 86 in order to determine the precise voltage at which the current exceeds a threshold (e.g., 8 μA) as determined by a current threshold detector 88.

The printer control firmware 94 compares this voltage value with an experimentally-or arithmetically-determined breakdown voltage (e.g., +1200 volts) to the nearest electrically-conductive part in close proximity to the transfer roll 34. If the measured voltage value is less than the breakdown voltage, then it can be concluded that the photoconductor drum 32 is present. However, if the measured voltage value (hereinafter "first voltage value") is more than the breakdown voltage, it is unknown whether the current flow is actually through a photoconductor drum 32 or through a nearby electrically-conductive part such as a conductive brush (not shown).

In a second stage, rotation of the printer's drive motor continues, and one of the controllable elements in contact with the photoconductor drum 32 is manipulated by the printer control firmware to discharge a portion of the photoconductor drum 32. In one embodiment, the scanning laser beam 24 may be used as the discharge means by turning the laser on for a short amount of time (e.g., 100 ms). The discharged area created will ideally be just larger than the contact area between the photoconductor drum and the transfer roll.

The voltage applied to the charge roll 34 can also be used to create a similar effect. Likewise, a similar effect could be produced by manipulating the voltage applied to the developer roll (not shown), but may have the undesired side effect of developing toner to the photoconductor drum, which would waste toner and likely require additional steps be taken to prevent the toner from contaminating the printed output or the printer itself. Furthermore, the transfer roll 30 itself could be used as a discharging means but would not be preferred because the sensing could not be performed until nearly one full revolution of the photoconductor drum took place after the discharging.

Theoretically, the first voltage value may be sufficient without any increase for use in the second stage, but using a slight increase of voltage (e.g., higher by 200 volts) provides immunity to small variations in properties of the photoconductor drum. The magnitude of increase from the first voltage may be less than the amount of discharge effected by discharging means (for example, the laser, which can be expected to discharge the photoconductor drum surface by approximately 650 volts). When the discharged area of the rotating (and assumed installed) photoconductor drum 32 reaches the point where it contacts the transfer roll 34, a change in the transfer current feedback signal, detected by current monitor 86 (indicating a decrease in current), conclusively indicates that the photoconductor drum is installed.

By contrast, a lack of change in the transfer current feedback signal conclusively indicates that the photoconductor drum is not installed (assuming only that the laser is operating—which is confirmed via another means outside the context of this discussion, and that the laser beam is not blocked from reaching the photoconductor drum surface). The discharging of portions of the photoconductor drum surface and subsequent sensing may be repeated any number of times to provide redundant measurements.

In one embodiment, a method starts with determining the first voltage, continuing to the second stage if the first voltage is inconclusive. In a second embodiment, the first stage is slightly modified to replace the "experimentally or arithmetically-determined breakdown voltage" with the voltage defined as the highest specified regulated transfer voltage available from the high-voltage power supply (e.g., +2650 volts) minus the minimum voltage increase required for "immunity to small variations" as discussed in connection with the second stage. This modification may be made for two reasons: to prevent operation of the high-voltage power supply beyond specification limits, and to provide simplicity in the controlling firmware.

Figure 3:
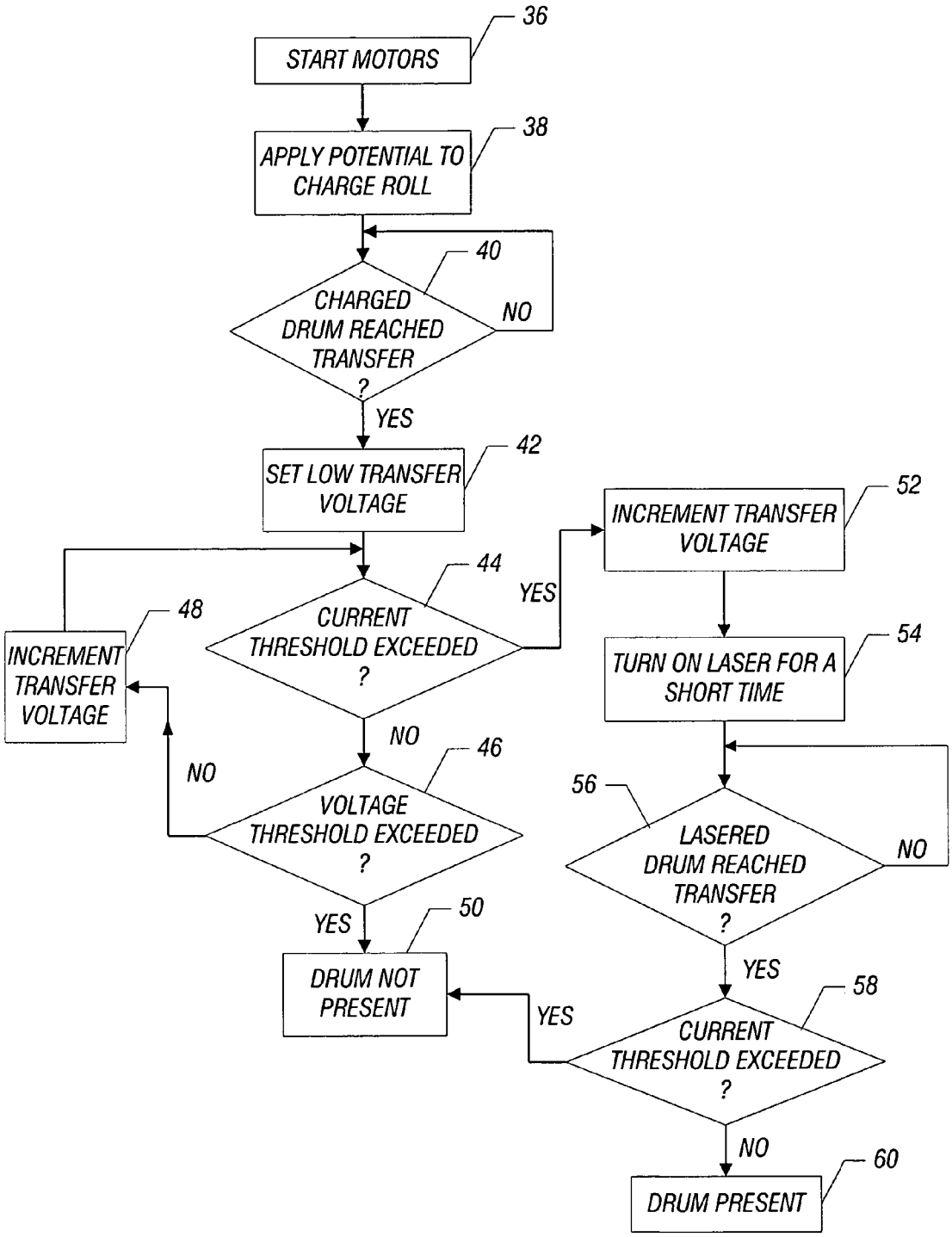
FIG. 3 is a flow chart for one embodiment of the invention shown in FIGS. 1 and 2.

Referring to FIG. 3, in the second embodiment, the printer control firmware 94 runs the printer's drive motor so that any installed photoconductor drum rotates as indicated in block 36. A highly negative voltage is applied to the charge roll (block 38), which charges the surface of any installed photoconductor drum. After enough time has elapsed for the charged portion of the photoconductor drum to be in contact with the transfer roll (as determined in diamond 40), the printer control firmware begins to vary the voltage applied to the transfer roll (block 42) and monitor the transfer current feedback (diamond 44) in order to determine the precise voltage at which the current exceeds the threshold. If the current threshold is not exceeded, a check in diamond 46 determines whether the voltage threshold is exceeded. If not the transfer voltage is increased (block 48) and the flow iterates. If the result is greater than the high-voltage power supply maximum voltage minus a desired voltage margin, the determination is made that the photoconductor drum is not installed (block 50). If not, and the current threshold is exceeded (diamond 44), rotation of the printer's drive motor is continued and the laser is turned on for a short amount of time by the printer control firmware to discharge a portion of the photoconductor drum (block 54). The transfer roll is maintained slightly above the voltage value determined above (block 52). When the discharged area of the rotating (and assumed installed) photoconductor drum reaches the point where it contacts the transfer roll (diamond 56), a change in the transfer current feedback signal, identified at diamond 58 (indicating a decrease in current) conclusively indicates that the photoconductor drum is installed (block 60). By contrast, a lack of change in the transfer current feedback signal indicates that the photoconductor drum is not installed (block 50).

In the second embodiment, if the determination is made that photoconductor unit is not installed, a message is conveyed to the user, via display 92 for example, indicating as such. The message may also be conveyed via operator panel, via the software driver on the host computer, or other similar and available means. Operation of the printer is preferably not resumed until an action is detected that indicates that a photoconductor unit may have been replaced has taken place. These actions may be powering on of the printer, or when the access door to the part of the printer where the photoconductor unit is located has been closed. These scenarios can be extended to a more generalized case to provide efficiencies in the control firmware, but because the detection may take some time, it is preferred that the detection not take place during or between normal printing operations.

References throughout this specification to "one embodiment" or "an embodiment" mean that a particular feature, structure, or characteristic described in connection with the embodiment is included in at least one implementation encompassed within the present invention. Thus, appearances of the phrase "one embodiment" or "in an embodiment" are not necessarily referring to the same embodiment. Furthermore, the particular features, structures, or characteristics may be instituted in other suitable forms other than the particular embodiment illustrated and all such forms may be encompassed within the claims of the present application.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A methods comprising:

detecting the presence of a photoconductor drum in a laser printer by measuring an electrical characteristic of a roll that transfers charge to the photoconductor drum when present, including altering a voltage applied to said roll and monitoring current supplied to said roll.

2. The method of claim 1 wherein altering the applied voltage includes one of gradually increasing and gradually decreasing the applied voltage and monitoring the supplied current includes monitoring the supplied current to determine whether the supplied current exceeds a threshold.

3. The method of claim 2 wherein the altering comprises altering the applied voltage until the applied voltage reaches a breakdown voltage from said roll to a proximate printer element or the supplied current exceeds the threshold.

4. The method of claim 3 wherein the photoconductive drum is determined to be absent if the applied voltage reaches the breakdown voltage without the supplied current exceeding the threshold.

5. The method of claim 2 further including attempting to discharge said photoconductor drum if the supplied current exceeds the threshold.

6. The method of claim 5 wherein attempting includes attempting to expose said photoconductor drum to a laser beam.

7. The method of claim 5, further including determining, following the attempting, whether the supplied current changes and if so determining that said photoconductive drum is present.

8. The method of claim 1 including attempting to discharge charge from a location where a photoconductive drum would be if installed, to determine if the photoconductive drum is present.

9. The method of claim 1, including directing a laser beam towards a location where a photoconductive drum would be located if installed, to discharge charge.

10. A laser printer comprising:

a transfer roll;

a detector to detect the presence of a photoconductor drum by measuring an electrical characteristic of said transfer roll that transfers charge to said photoconductor drum when present; and a device to alter a voltage applied to said transfer roll and to monitor current supplied to said transfer roll.

11. The printer of claim 10, wherein said detector identifies when the supplied current exceeds a threshold.

12. The printer of claim 11, further comprising a laser which attempts to discharge said drum following the the supplied current exceeding the threshold.

13. The printer of claim 12, wherein said detector determines, following the attempt to discharge, that said drum is present upon detecting a change in the supplied current.

14. The printer of claim 10, wherein said device is capable of performing one of gradually increasing and gradually decreasing the applied voltage until the applied voltage reaches a breakdown voltage from said transfer roll to a proximate printer element.

15. The printer of claim 14, wherein said detector determines that the photoconductive drum is not present if the supplied current does not exceed the threshold as the applied voltage reaches the breakdown voltage.

16. The printer of claim 10, further comprising a laser to discharge charge on said drum to determine whether the drum is present.

17. A computer readable medium storing instructions that, if executed, enable a printer to:

detect the presence of a photoconductor drum in a laser printer by measuring an electrical characteristic of a roll that transfers charge to the photoconductor drum when present including altering a voltage supplied to said roll and monitoring current supplied to said roll.

18. The medium of claim 17, wherein the instructions when executed enable the printer to one of gradually increase and gradually decrease the applied voltage while determining whether the supplied current exceeds a threshold.

19. The medium of claim 18, wherein the applied voltage is altered until, absent the supplied current exceeding the threshold, the applied voltage reaches a breakdown voltage from said roll to a proximate printer element.

20. The medium of claim 18, wherein the instructions enable the printer to determine that said drum is present if the supplied current exceeds a threshold while the applied voltage has not reached the breakdown voltage.

21. A method for determining presence of a photoconductive drum in an imaging device, comprising:

applying a first voltage to a roll that transfers charge to a photoconductor drum when installed in an imaging device;

attempting to discharge a charge from an area in the imaging device where a photoconductive drum is located when installed;

detecting a change in current supplied to the roll; and selectively determining that a photoconductive drum is present based upon the detection.

22. The method of claim 21, wherein attempting to discharge comprises directing a laser in a direction of the area where an installed photoconductive drum is located when installed.

23. The method of claim 21, further comprising selectively determining that a photoconductive drum is absent based upon the detected change in current not surpassing a predetermined amount.

24. The method of claim 21, wherein detecting a change in current comprises comparing a current change to a predetermined amount.

25. The method of claim 21, further comprising:

initially applying a varying voltage to the roll while monitoring a current supplied thereto, and applying the first voltage to the roll if the monitored current surpasses a predetermined amount.

* * * * *